US011802719B2

(12) United States Patent
Matsuda

(10) Patent No.: US 11,802,719 B2
(45) Date of Patent: Oct. 31, 2023

(54) REFRIGERATION CYCLE APPARATUS

(71) Applicant: Mitsubishi Electric Corporation, Tokyo (JP)

(72) Inventor: Takuya Matsuda, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 441 days.

(21) Appl. No.: 17/056,894

(22) PCT Filed: Jul. 20, 2018

(86) PCT No.: PCT/JP2018/027334
§ 371 (c)(1),
(2) Date: May 19, 2021

(87) PCT Pub. No.: WO2020/017036
PCT Pub. Date: Jan. 23, 2020

(65) Prior Publication Data
US 2021/0262703 A1 Aug. 26, 2021

(51) Int. Cl.
*F25B 13/00* (2006.01)
*F25B 39/02* (2006.01)

(52) U.S. Cl.
CPC ..... *F25B 13/00* (2013.01); *F25B 39/02* (2013.01)

(58) Field of Classification Search
CPC ..... F25B 13/00; F25B 39/02; F25B 41/24; F25B 2313/02531; F25B 2313/02533;
(Continued)

(56) References Cited

U.S. PATENT DOCUMENTS

2011/0056668 A1* 3/2011 Taras ..... F28F 9/262 165/174
2012/0118533 A1 5/2012 Jang et al.
(Continued)

FOREIGN PATENT DOCUMENTS

EP 3499142 A1 6/2019
JP S62-077769 U 5/1987
(Continued)

OTHER PUBLICATIONS

International Search Report of the International Searching Authority dated Sep. 25, 2018 for the corresponding International application No. PCT/JP2018/027334 (and English translation).
(Continued)

*Primary Examiner* — Henry T Crenshaw
*Assistant Examiner* — Kamran Tavakoldavani
(74) *Attorney, Agent, or Firm* — POSZ LAW GROUP, PLC

(57) ABSTRACT

The refrigerant circuit includes a compressor, an outdoor heat exchanger, an indoor heat exchanger, and a second flow path switching unit. The outdoor heat exchanger has a plurality of first flat heat transfer tubes, a plurality of second flat heat transfer tubes, and a plurality of third flat heat transfer tubes. The second flow path switching unit switches the refrigeration cycle apparatus between a third state and a fourth state. In the third state, the plurality of first flat heat transfer tubes and the plurality of third flat heat transfer tubes are sequentially connected in series. In the fourth state, the plurality of first flat heat transfer tubes, the plurality of second flat heat transfer tubes, and the plurality of third flat heat transfer tubes are connected in parallel to each other.

6 Claims, 9 Drawing Sheets

(58) Field of Classification Search
CPC .. F25B 2313/02541; F25B 2600/22511; F28D 1/024; F28D 1/0443; F28D 1/05366; F28F 1/022; F28F 1/325; F28F 9/26; F28F 27/02
USPC ..... 62/498
See application file for complete search history.

(56) References Cited

U.S. PATENT DOCUMENTS

| | | | | |
|---|---|---|---|---|
| 2013/0306285 | A1 | 11/2013 | Jindou et al. | |
| 2016/0178249 | A1 | 6/2016 | Kwon et al. | |
| 2018/0135900 | A1 | 5/2018 | Jindou et al. | |
| 2019/0162454 | A1 | 5/2019 | Hatomura et al. | |
| 2019/0383532 | A1 | 12/2019 | Mizutani | |
| 2020/0033033 | A1* | 1/2020 | Yoshioka | F28D 1/0471 |

FOREIGN PATENT DOCUMENTS

| | | | |
|---|---|---|---|
| JP | H5-118720 | A | 5/1993 |
| JP | 2012-107857 | A | 6/2012 |
| JP | 2012-163328 | A | 8/2012 |
| JP | 2014-112031 | A | 6/2014 |
| JP | 2016-205744 | A | 12/2016 |
| JP | 2017-053518 | A | 3/2017 |
| WO | 2015/063853 | A1 | 5/2015 |
| WO | 2018/029817 | A1 | 2/2018 |
| WO | 2018/047331 | A1 | 3/2018 |
| WO | 2018/047416 | A1 | 3/2018 |

OTHER PUBLICATIONS

Japanese Office Action dated Aug. 3, 2021, issued in corresponding Japanese National Phase Application No. 2020-530852 (and English machine translation).

* cited by examiner

REFRIGERATION CYCLE APPARATUS

CROSS REFERENCE TO RELATED APPLICATION

This application is a U.S. national stage application of International Application No. PCT/JP2018/027334 filed on Jul. 20, 2018, the contents of which are incorporated herein by reference.

TECHNICAL FIELD

The present invention relates to a refrigeration cycle apparatus.

BACKGROUND

Conventionally, there is known such a heat exchanger that is provided with a plurality of flat heat transfer tubes and configured to exchange heat between refrigerant that flows in each flat heat transfer tube and air.

As an example of such a heat exchanger, a single-row heat exchanger in which a plurality of flat heat transfer tubes are arranged side by side in a direction perpendicular to the air flow direction but only in one row in the air flow direction (see, for example, Japanese Patent Laying-Open No. 2012-163328), and a multiple-row heat exchanger in which a plurality of flat heat transfer tubes are arranged side by side in multiple rows in the air flow direction (see, for example, Japanese Patent Laying-Open No. 2016-205744) may be given.

PATENT LITERATURE

PTL 1: Japanese Patent Laying-Open No. 2012-163328
PTL 2: Japanese Patent Laying-Open No. 2016-205744

A common single-row heat exchanger is configured to increase the length of a refrigerant flow path disposed in each flat heat transfer tube relatively longer so as to improve the condensation capacity. Therefore, when the single-row heat exchanger operates as an evaporator, the pressure loss of the refrigerant in each flat heat transfer tube is larger than the case where the single-row heat exchanger operates as a condenser, which reduces the heat exchange efficiency of the single-row heat exchanger.

In a multiple-row heat exchanger, the refrigerant is evenly distributed in the flat heat transfer tubes arranged in the windward row and in the flat heat transfer tubes arranged in the leeward row, and however, the work load of the windward row is different from the work load of the leeward row, which makes the state of the refrigerant flowing out from the outlet of each flat heat transfer tube in the windward row different the state of the refrigerant flowing out from the outlet of each flat heat transfer tube in the leeward row. Thus, the heat exchange efficiency of the multiple-row heat exchanger decreases as compared with the case where the state of the refrigerant flowing out from the outlet of each flat heat transfer tube in the windward row is the same as the state of the refrigerant flowing out from the outlet of each flat heat transfer tube in the leeward row.

In order to prevent the heat exchange efficiency from decreasing, there is a need to provide a switching mechanism that switches the number of refrigerant flow paths to be connected in parallel with each other in the heat exchanger, the length of each refrigerant flow path, or the flow rate of the refrigerant flowing in each refrigerant flow path between the cooling operation and the heating operation, which makes the structure of the heat exchanger or the arrangement of pipes connected to the heat exchanger complicated.

SUMMARY

A main object of the present invention is to provide a refrigeration cycle apparatus in which the structure of a heat exchanger and the arrangement of pipes connected to the heat exchanger are simplified and the heat exchange efficiency of an outdoor heat exchanger is improved, as compared with a conventional refrigeration cycle apparatus which includes a single-row heat exchanger or a multiple-row heat exchanger described above as the outdoor heat exchanger.

A refrigeration cycle apparatus according to the present invention includes a refrigerant circuit in which refrigerant circulates. The refrigerant circuit includes a compressor, a first flow path switching unit, a second flow path switching unit, a decompressor, an indoor heat exchanger, and an outdoor heat exchanger. The outdoor heat exchanger includes a plurality of flat heat transfer tubes which are spaced from each other in a first direction and configured to extend in a second direction crossing the first direction, a plurality of plate-shaped members which are spaced from each other in a second direction and connected to each of the plurality of flat heat transfer tubes, a first distributor which is connected to one ends of the plurality of flat heat transfer tubes in the second direction, and a second distributor which is connected to the other ends of the plurality of flat heat transfer tubes in the second direction. The number of one ends of the plurality of flat heat transfer tubes in the second direction is equal to the number of the other ends of the plurality of flat heat transfer tubes in the second direction. The plurality of flat heat transfer tubes are arranged in one row in a third direction crossing the first direction and the second direction. The plurality of flat heat transfer tubes includes a plurality of first flat heat transfer tubes, a plurality of second flat heat transfer tubes, and a plurality of third flat heat transfer tubes which are arranged side by side in the first direction. The first distributor includes a first distribution pipe which connects one ends of the plurality of first flat heat transfer tubes in the second direction in parallel, a second distribution pipe which connects one ends of the plurality of second flat heat transfer tubes in the second direction in parallel, and a third distribution pipe which connects one ends of the plurality of third flat heat transfer tubes in the second direction in parallel. The second distributor includes a forth distribution pipe which connects the other ends of the plurality of first flat heat transfer tubes in the second direction in parallel, a fifth distribution pipe which connects the other ends of the plurality of second flat heat transfer tubes in the second direction in parallel, and a sixth distribution pipe which connects the other ends of the plurality of third flat heat transfer tubes in the second direction in parallel. The first flow path switching unit is configured to switch the refrigeration cycle apparatus between a first state and a second state, and in the first state, the outdoor heat exchanger operates as a condenser and the indoor heat exchanger operates as an evaporator, and in the second state, the outdoor heat exchanger operates as an evaporator and the indoor heat exchanger operates as a condenser. The second flow path switching unit is provided with a first port, a second port, a third port, a fourth port, a fifth port, a sixth port, a seventh port, and an eighth port through each of which the refrigerant flows in and out. The first port is connected to a discharge port of the compressor via the first flow path switching unit in the first state, and connected to a suction port of the compressor via the first flow path switching unit in the second state. The second port is connected to the first distribution pipe. The third port is connected to the second distribution pipe. The fourth port is connected to the third distribution pipe. The fifth port is connected to the fourth distribution pipe. The sixth port is connected to the fifth distribution pipe. The seventh port is connected to the sixth distribution pipe. The eighth port is connected to the indoor heat exchanger via the decompressor. The second flow switching unit is configured to switch the refrigeration cycle apparatus between a third state and a fourth state. In the third state, the first port, the second port, the plurality of first flat heat transfer tubes, the fifth port, the fourth port, the plurality of third flat heat transfer tubes, the seventh port, and the eighth port are connected in series in this order, and the first port, the third port, the plurality of second flat heat transfer tubes, the sixth port, the fourth port, the plurality of third flat heat transfer tubes, the seventh port, and the eighth port are connected in series in this order, and in the fourth state, the fifth port, the sixth port, and the seventh port are connected in parallel to the eighth port, and the second port, the third port, and the fourth port are connected in parallel to the first port.

Since the outdoor heat exchanger of the refrigeration cycle apparatus according to the present invention is provided with three or more heat exchange units and the plurality of flat heat transfer tubes are arranged in one row in the third direction, as compared with the multiple-row heat exchanger described above, the structure of the heat exchanger and the arrangement of pipes are simplified, and the heat exchange efficiency is improved. Further, since the refrigeration cycle apparatus according to the present invention is provided with the outdoor heat exchanger and the second flow path switching unit, as compared with the conventional single-row heat exchanger, the structure of the heat exchanger and the arrangement of pipes are simplified, and the heat exchange efficiency is improved. In other words, as compared with a conventional refrigeration cycle apparatus that includes the single-row heat exchanger or the multiple-row heat exchanger described above as the outdoor heat exchanger, the refrigeration cycle apparatus according to the present invention is simple in the structure of the heat exchanger and the arrangement of pipes, but better in the heat exchange efficiency of the outdoor heat exchanger.

DETAILED DESCRIPTION

Hereinafter, embodiments of the present invention will be described in detail with reference to the drawings. In the following, for the convenience of description, it is supposed that a first direction Z, a second direction X, and a third direction Y are perpendicular to each other.

First Embodiment

Figure 1:
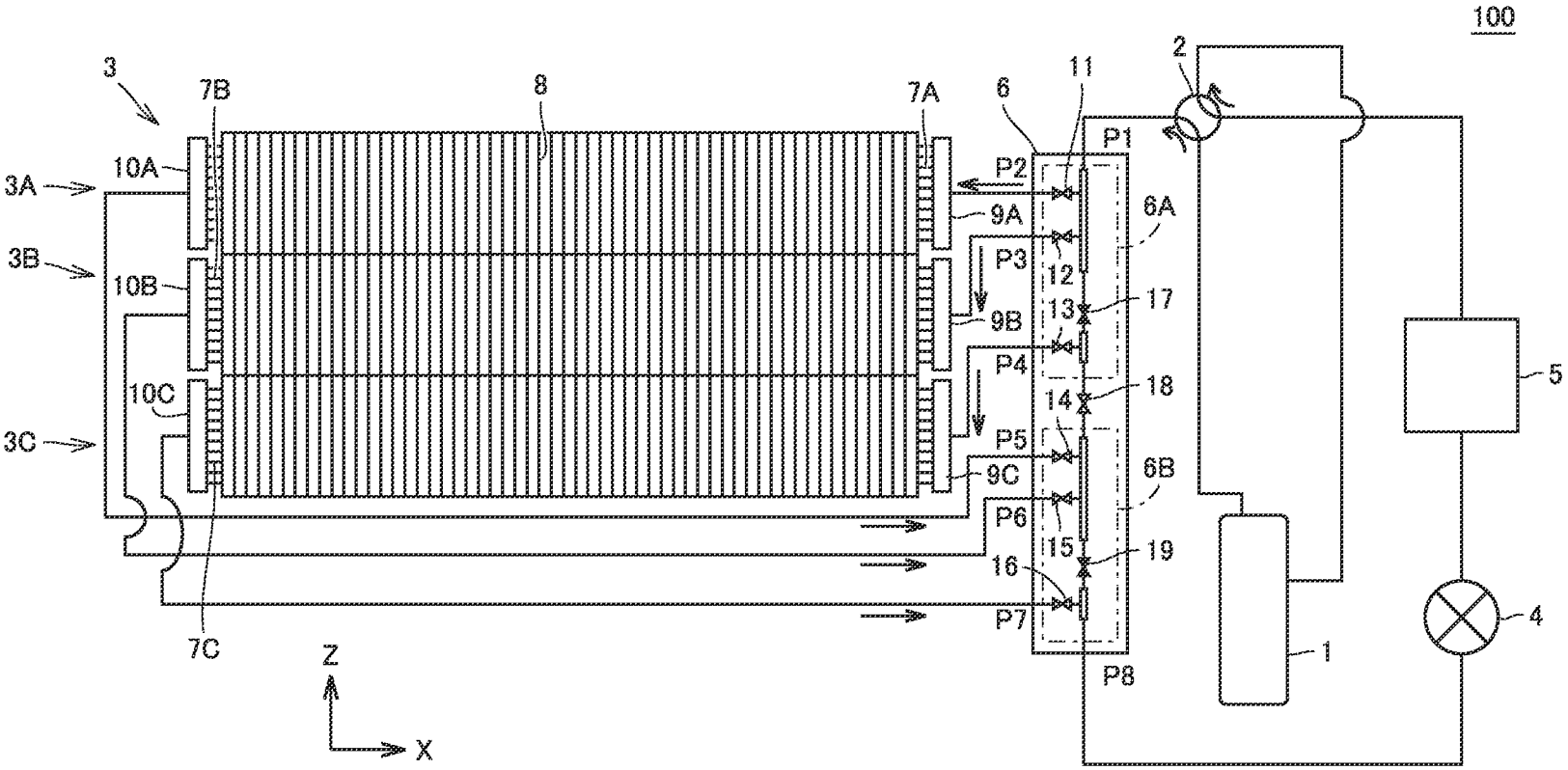
FIG. 1 is a view illustrating a refrigerant circuit when a refrigeration cycle apparatus according to a first embodiment is in a third state.

As illustrated in FIG. 1, a refrigeration cycle apparatus 100 according to a first embodiment includes a refrigerant circuit in which refrigerant circulates. The refrigerant circuit includes a compressor 1, a four-way valve 2 which serves as a first flow path switching unit, an outdoor heat exchanger 3, a decompressor 4, an indoor heat exchanger 5, and a second flow path switching unit 6. The compressor 1, the four-way valve 2, the outdoor heat exchanger 3, the decompressor 4, and the second flow path switching unit 6 are accommodated in an outdoor apparatus. The indoor heat exchanger 5 is accommodated in an indoor apparatus. The refrigeration cycle apparatus 100 further includes an outdoor fan (not shown) configured to blow air to the outdoor heat exchanger 3, and an indoor fan (not shown) configured to blow air to the indoor heat exchanger 5.

The compressor 1 is provided with a discharge port which is configured to discharge refrigerant and a suction port which is configured to suck refrigerant.

The four-way valve 2 includes a first opening connected to the discharge port of the compressor 1 via a discharge pipe, a second opening connected to the suction port of the compressor 1 via a suction pipe, a third opening connected to the indoor heat exchanger 5, and a fourth opening connected to the outdoor heat exchanger 3 via the second flow path switching unit 6. The fourth opening of the four-way valve 2 is connected to a first port P1 of the second flow path switching unit 6. The four-way valve 2 is configured to switch the refrigeration cycle apparatus between a first state in which the outdoor heat exchanger 3 operates as a condenser and the indoor heat exchanger 5 operates as an evaporator, and a second state in which the outdoor heat exchanger 3 operates as an evaporator and the indoor heat exchanger 5 operates as a condenser. The arrows in solid line as illustrated in FIG. 1 indicate the flow direction of refrigerant that circulates in the refrigerant circuit when the refrigeration cycle apparatus 100 is in the first state, and arrows in dotted line as illustrated in FIG. 1 indicate the flow direction of refrigerant that circulates in the refrigerant circuit when the refrigeration cycle apparatus 100 is in the second state.

The outdoor heat exchanger 3 includes a plurality of flat heat transfer tubes 7, a plurality of plate-shaped members 8, a first distributor 9, and a second distributor 10.

The plurality of flat heat transfer tubes 7 are spaced from each other in the first direction Z and configured to extend in the second direction X perpendicular to the first direction Z. The plurality of flat heat transfer tubes 7 are divided into at least a plurality of first flat heat transfer tubes 7A, a plurality of second flat heat transfer tubes 7B, and a plurality of third flat heat transfer tubes 7C. The plurality of first flat heat transfer tubes 7A, the plurality of second flat heat transfer tubes 7B, and the plurality of third flat heat transfer tubes 7C are arranged in one column in the first direction Z. In the third direction Y, the plurality of first flat heat transfer tubes 7A, the plurality of second flat heat transfer tubes 7B, and the plurality of third flat heat transfer tubes 7C are arranged in one row. In other words, the outdoor heat exchanger 3 is a single-row heat exchanger.

The plurality of plate-shaped members 8 are spaced from each other in the second direction X, and are connected to each of the plurality of first flat heat transfer tubes 7A, each of the plurality of second flat heat transfer tubes 7B, and each of the plurality of third flat heat transfer tubes 7C.

The first distributor 9 is configured to connect one ends of the plurality of first flat heat transfer tubes 7A, the plurality of second flat heat transfer tubes 7B, and the plurality of third flat heat transfer tubes 7C in the second direction X in parallel. The first distributor 9 is divided into at least a first distribution pipe 9A, a second distribution pipe 9B, and a third distribution pipe 9C.

The second distributor 10 is configured to connect the other ends of the plurality of first flat heat transfer tubes 7A, the plurality of second flat heat transfer tubes 7B, and the plurality of third flat heat transfer tubes 7C in the second direction X in parallel. The second distributor 10 is divided into at least a fourth distribution pipe 10A, a fifth distribution pipe 10B, and a sixth distribution pipe 10C.

The outdoor heat exchanger 3 includes a first heat exchange unit 3A, a second heat exchange unit 3B, and a third heat exchange unit 3C. The first heat exchange unit 3A, the second heat exchange unit 3B, and the third heat exchange unit 3C are arranged side by side in the first direction Z in this order. The first heat exchange unit 3A is arranged on one side of the first direction Z. The third heat exchange unit 3C is arranged on the other side of the first direction Z. The second heat exchange unit 3B is arranged between the first heat exchange unit 3A and the third heat exchange unit 3C in the first direction Z. The first heat exchange unit 3A, the second heat exchange unit 3B, and the third heat exchange unit 3C have, for example, the same configuration.

The first heat exchange unit 3A is constituted by the plurality of first flat heat transfer tubes 7A, a part of each of the plurality of plate-shaped members 8, the first distribution pipe 9A, and the fourth distribution pipe 10A.

The second heat exchange unit 3B is constituted by the plurality of second flat heat transfer tubes 7B, a part of each of the plurality of plate-shaped members 8, the second distribution pipe 9B, and the fifth distribution pipe 10B.

The third heat exchange unit 3C is constituted by the plurality of third flat heat transfer tubes 7C, a part of each of the plurality of plate-shaped members 8, the third distribution pipe 9C, and the sixth distribution pipe 10C.

The cross section of each of the plurality of first flat heat transfer tubes 7A, the plurality of second flat heat transfer tubes 7B, and the plurality of third flat heat transfer tubes 7C, when viewed from a direction perpendicular to the second direction X, has a flat shape. For example, the long axis of the flat shape is in the horizontal direction. From the viewpoint of improving the heat exchange efficiency of the outdoor heat exchanger 3, the ratio (aspect ratio) of the length of the long axis of the flat shape to the length of the short axis of the flat shape is 15 or more, and preferably 20 or more.

Each plate-shaped member 8 operates as a plate fin. Each plate-shaped member 8 has a surface that extends along the first direction Z and the third direction Y, and the surface is provided with a plurality of insertion holes. The plurality of insertion holes provided on one plate-shaped member 8 are spaced from each other in the first direction Z. When viewed from the second direction X, the plurality of insertion holes provided on one plate-shaped member 8 overlap with the plurality of insertion holes provided on another plate-shaped member 8, respectively. Each insertion hole may be formed as, for example, a notch which has an opening at one end of each plate-shaped member 8 in the third direction Y, or may be formed as a through hole completely surrounded by each plate-shaped member 8. In the case where each insertion hole is formed as a notch, the opening of the notch is arranged leeward when the outdoor fan blows air to the outdoor heat exchanger 3 in the third direction Y.

The first distribution pipe 9A connects one ends of the plurality of first flat heat transfer tubes 7A in the second direction X in parallel. The fourth distribution pipe 10A connects the other ends of the plurality of first flat heat transfer tubes 7A in the second direction X in parallel. In the first heat exchange unit 3A, the plurality of first flat heat transfer tubes 7A, the first distribution pipes 9A, and the fourth distribution pipes 10A constitute a part of the refrigerant circuit.

The second distribution pipe 9B connects one ends of the plurality of second flat heat transfer tubes 7B in the second direction X in parallel. The fifth distribution pipe 10B connects the other ends of the plurality of second flat heat transfer tubes 7B in the second direction X in parallel. In the second heat exchange unit 3B, the plurality of second flat heat transfer tubes 7B, the second distribution pipes 9B, and the fifth distribution pipes 10B constitute a part of the refrigerant circuit.

The third distribution pipe 9C connects one end of each of the plurality of third flat heat transfer tubes 7C in the second direction X in parallel. The sixth distribution pipe 10C connects the other ends of the plurality of third flat heat transfer tubes 7C in the second direction X in parallel. In the third heat exchange unit 3C, the plurality of third flat heat transfer tubes 7C, the third distribution pipes 9C, and the sixth distribution pipes 10C constitute a part of the refrigerant circuit.

The capacity of the first heat exchange unit 3A, the capacity of the second heat exchange unit 3B, and the capacity of the third heat exchange unit 3C may be equal to each other or may be different from each other.

In the first state and the second state, the first distribution pipe 9A is arranged on a gas refrigerant side of the first heat exchange unit 3A, and the fourth distribution pipe 10A is arranged on a liquid refrigerant side of the first heat exchange unit 3A. In the first state and the second state, the second distribution pipe 9B is arranged on the gas refrigerant side of the second heat exchange unit 3B, and the fifth distribution pipe 10B is arranged on the liquid refrigerant side of the second heat exchange unit 3B. In the first state and the second state, the third distribution pipe 9C is arranged on the gas refrigerant side of the third heat exchange unit 3C, and the sixth distribution pipe 10C is arranged on the liquid refrigerant side of the third heat exchange unit 3C.

The liquid refrigerant side of each heat exchange unit refers to the side where the liquid refrigerant flows out when the heat exchange unit operates as a condenser, and the side where the liquid refrigerant flows in when the heat exchange unit operates as an evaporator. The liquid refrigerant refers to a liquid single-phase refrigerant or a gas-liquid two-phase refrigerant that contains a larger amount of liquid refrigerant. On the other hand, the gas refrigerant side of each heat exchange unit refers to the side where the gas refrigerant flows in when the heat exchange unit operates as a condenser, and the side where the gas refrigerant flows out when the heat exchange unit operates as an evaporator. The gas refrigerant refers to a gas single-phase refrigerant.

The second flow path switching unit 6 is provided with a first port P1, a second port P2, a third port P3, a fourth port P4, a fifth port P5, a sixth port P6, a seventh port P7, and an eighth port P8 through each of which the refrigerant flows in and out. The second flow path switching unit 6 is formed as an integral unit.

The first port P1 is connected to the fourth opening of the four-way valve 2. In other words, the first port P1 is connected to the discharge port of the compressor 1 via the four-way valve 2 in the first state, and connected to the suction port of the compressor 1 via the four-way valve 2 in the second state. The second port P2 is connected to the first distribution pipe 9A. The third port P3 is connected to the second distribution pipe 9B. The fourth port P4 is connected to the third distribution pipe 9C. The fifth port P5 is connected to the fourth distribution pipe 10A. The sixth port P6 is connected to the fifth distribution pipe 10B. The seventh port P7 is connected to the sixth distribution pipe 10C. The eighth port P8 is connected to the indoor heat exchanger 5 via the decompressor 4.

The second flow path switching unit 6 is further provided with a first conduit which is connected between the first port P1 and the eighth port P8, and a second conduit, a third conduit, a fourth conduit, a fifth conduit, a sixth conduit, and a seventh conduit which are sequentially connected to the first conduit along the extending direction of the first conduit from the first port P1 to the eighth port P8. The first conduit extends linearly, for example.

The second conduit is connected between the second port P2 and the first conduit. The third conduit is connected between the third port P3 and the first conduit. The fourth conduit is connected between the fourth port P4 and the first conduit. The fifth conduit is connected between the fifth port P5 and the first conduit. The sixth conduit is connected between the sixth port P6 and the first conduit. The seventh conduit is connected between the seventh port P7 and the first conduit.

A joint between the first conduit and the second conduit is defined as a first joint. A joint between the first conduit and the third conduit is defined as a second joint. A joint between the first conduit and the fourth conduit is defined as a third joint. A joint between the first conduit and the fifth conduit is defined as a fourth joint. A joint between the first conduit and the sixth conduit is referred to as a fifth joint. A joint between the first conduit and the seventh conduit is referred to as a sixth joint.

As illustrated in FIGS. 1 to 5, the second flow path switching unit 6 is provided with, for example, a first on-off valve 11, a second on-off valve 12, a third on-off valve 13, a fourth on-off valve 14, a fifth on-off valve 15, a sixth on-off valve 16, a seventh on-off valve 17, an eighth on-off valve 18, and a ninth on-off valve 19.

The first on-off valve 11 is configured to open and close the second conduit. The third on-off valve 13 is configured to open and close the fourth conduit. The fourth on-off valve 14 is configured to open and close the fifth conduit. The sixth on-off valve 16 is configured to open and close the seventh conduit. The seventh on-off valve 17 is configured to open and close a part of the first conduit located between the second joint and the third joint. The eighth on-off valve 18 is configured to open and close a part of the first conduit located between the third joint and the fourth joint. The ninth on-off valve 19 is configured to open and close a part of the first conduit located between the fifth joint and the sixth joint.

The second flow path switching unit 6 is formed as an integral unit. The second flow path switching unit 6 may be divided into, for example, a first block and a second block with the eighth on-off valve 18 disposed therebetween. The first block is constituted by a part of the first conduit, the second conduit, the third conduit, the fourth conduit, the first on-off valve 11, the second on-off valve 12, the third on-off valve 13, and the seventh on-off valve 17. The second block is constituted by another part of the first conduit, the fifth conduit, the sixth conduit, the seventh conduit, the fourth on-off valve 14, the fifth on-off valve 15, the sixth on-off valve 16, and the ninth on-off valve 19. The first block is arranged on the gas refrigerant side with respect to the first heat exchange unit 3A, the second heat exchange unit 3B and the third heat exchange unit 3C in the first state and the second state. The second block is arranged on the liquid refrigerant side with respect to the first heat exchange unit 3A, the second heat exchange unit 3B and the third heat exchange unit 3C in the first state and the second state.

The coefficient of variation (Cv) of each of the first on-off valve 11, the second on-off valve 12, the third on-off valve 13 and the seventh on-off valve 17 which are included in the first block is larger than, for example, the Cv of each of the fourth on-off valve 14, the fifth on-off valve 15, the sixth on-off valve 16 and the ninth on-off valve 19 which are included in the second block.

Each inner diameter of a part of the first conduit, the second conduit, the third conduit and the fourth conduit which are included in the first block is larger than, for example, each inner diameter of the other part of the first conduit, the fifth conduit, the sixth conduit and the seventh conduit which are included in the second block.

The second port P2, the third port P3, the fourth port P4, the fifth port P5, the seventh port P7, and the eighth port P8 are flush with each other, for example. It is acceptable that the first port P1, the second port P2, the third port P3, the fourth port P4, the fifth port P5, the sixth port P6, the seventh port P7, and the eighth port P8 are flush with each other.

As illustrated in FIGS. 1 to 5, the second flow path switching unit 6 is configured to switch the refrigeration cycle apparatus between the third state, the fourth state, the fifth state, the sixth state, and the seventh state.

As illustrated in FIG. 1, in the third state, the first on-off valve 11, the second on-off valve 12, the third on-off valve 13, the fourth on-off valve 14, the fifth on-off valve 15, the sixth on-off valve 16 and the eighth on-off valve 18 are open, and the seventh on-off valve 17 and the ninth on-off valve 19 are closed.

Figure 2:
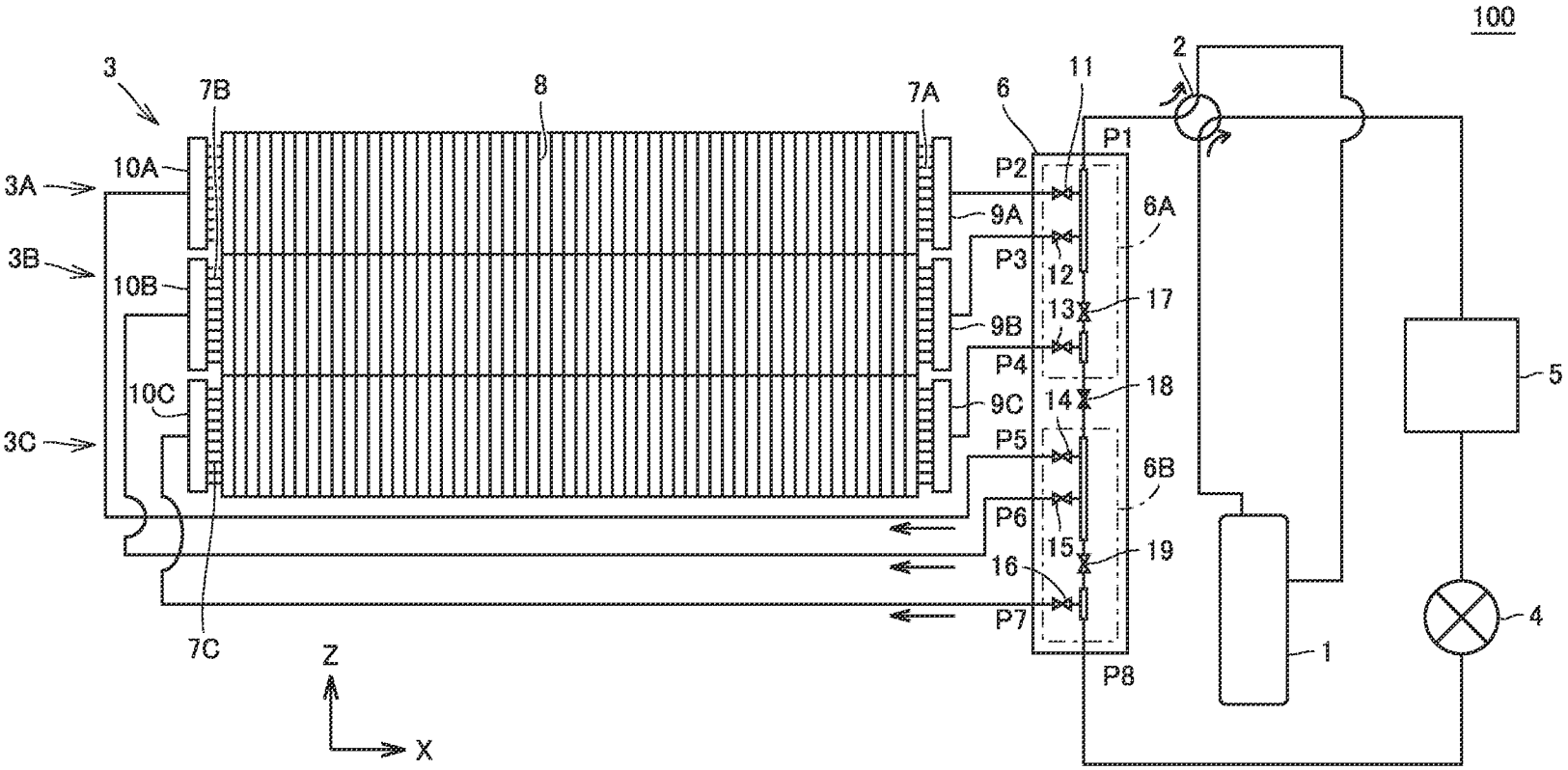
FIG. 2 is a view illustrating a refrigerant circuit when the refrigeration cycle apparatus according to the first embodiment is in a fourth state.

As illustrated in FIG. 2, in the fourth state, the first on-off valve 11, the second on-off valve 12, the third on-off valve 13, the fourth on-off valve 14, the fifth on-off valve 15, the sixth on-off valve 16, the seventh on-off valve 17 and the ninth on-off valve 19 are open, and the eighth on-off valve 18 is closed.

Figure 3:
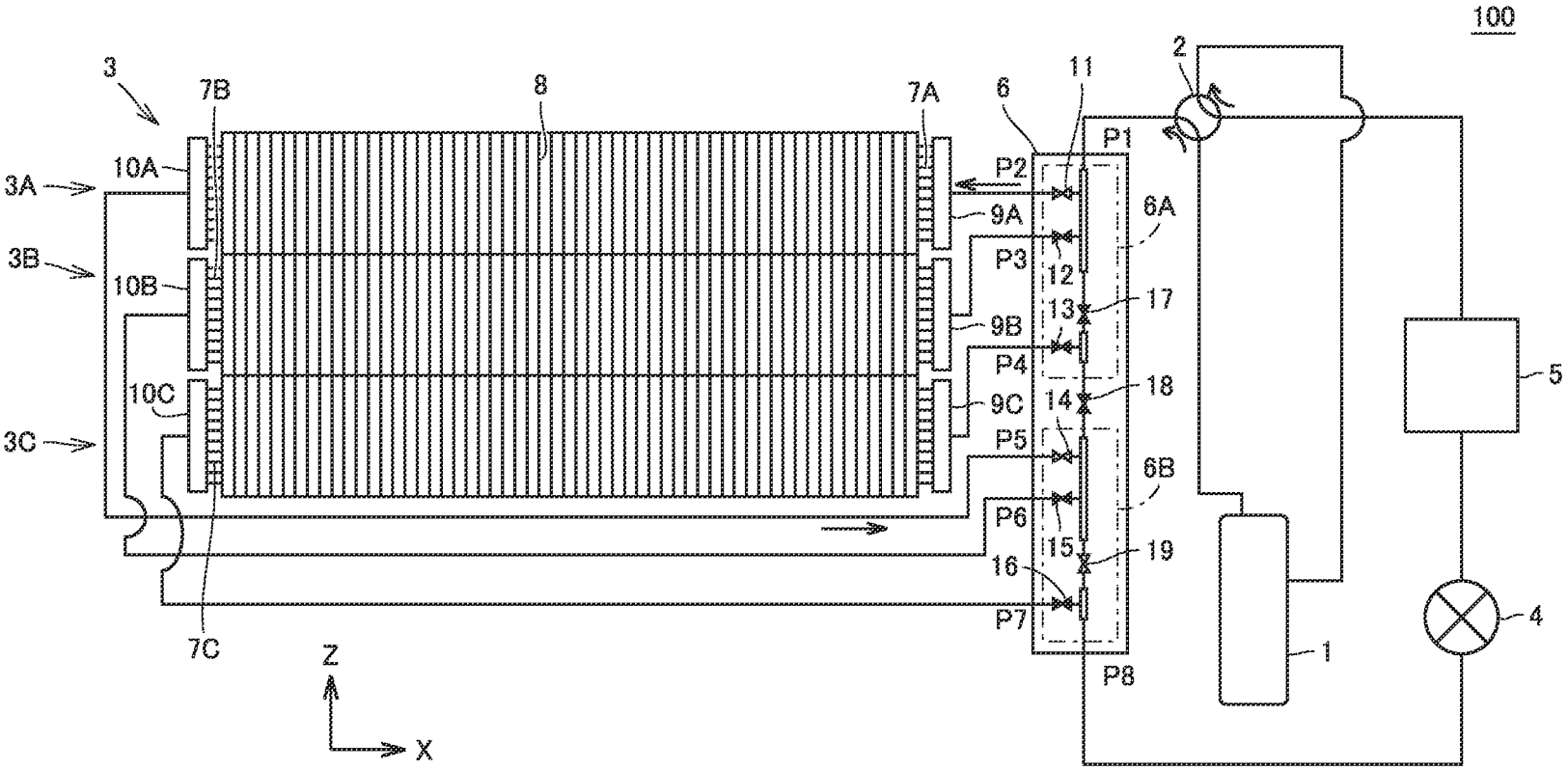
FIG. 3 is a view illustrating a refrigerant circuit when the refrigeration cycle apparatus according to the first embodiment is in a fifth state.

As illustrated in FIG. 3, in the fifth state, the first on-off valve 11, the fourth on-off valve 14 and the ninth on-off valve 19 are open, and the second on-off valve 12, the third on-off valve 13, the fifth on-off valve 15, the sixth on-off valve 16, the seventh on-off valve 17 and the eighth on-off valve 18 are closed.

Figure 4:
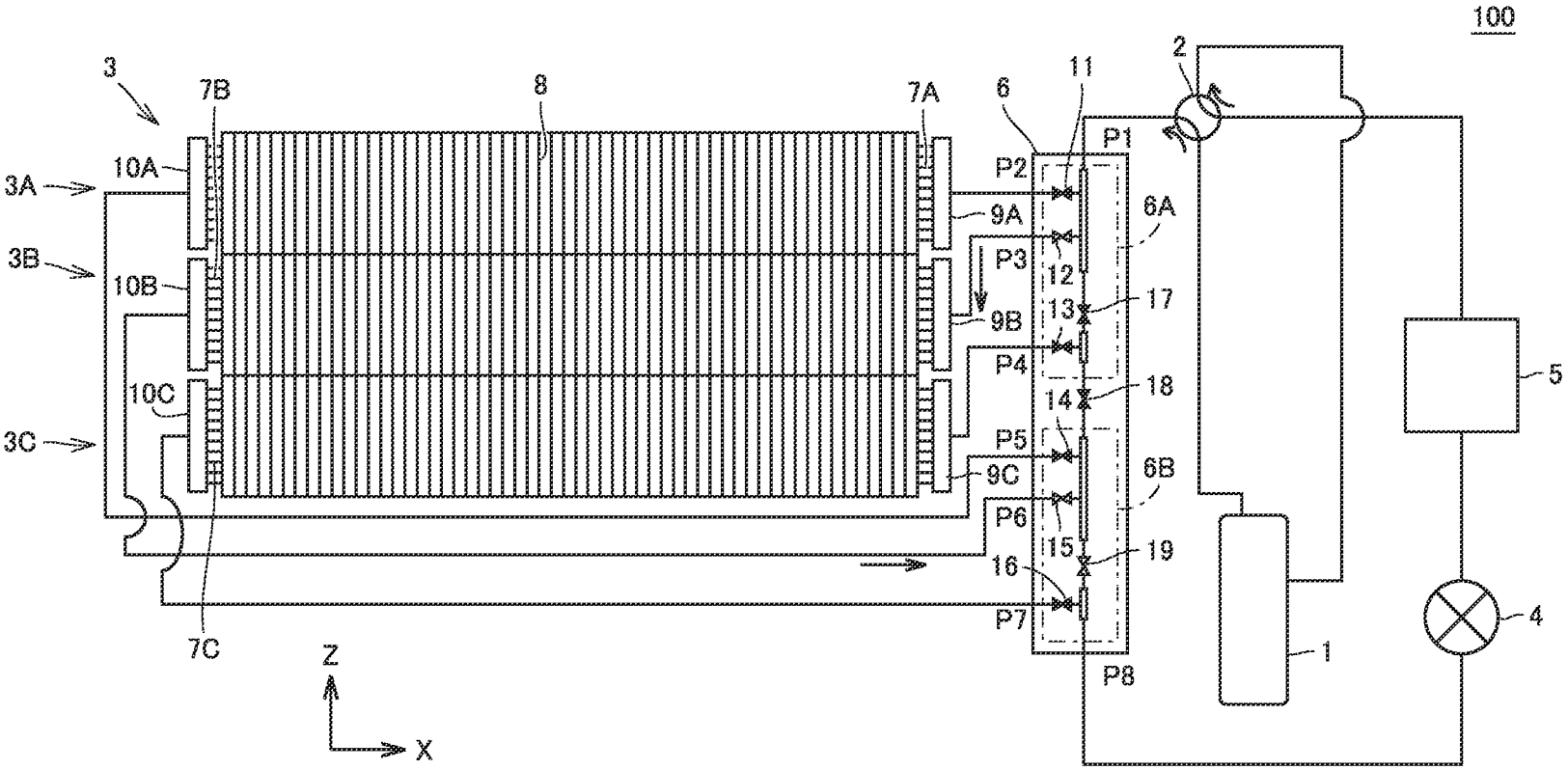
FIG. 4 is a view illustrating a refrigerant circuit when the refrigeration cycle apparatus according to the first embodiment is in a sixth state.

As illustrated in FIG. 4, in the sixth state, the second on-off valve 12, the fifth on-off valve 15 and the ninth on-off valve 19 are open, and the first on-off valve 11, the third on-off valve 13, the fourth on-off valve 14, the sixth on-off valve 16, the seventh on-off valve 17 and the eighth on-off valve 18 are closed.

Figure 5:
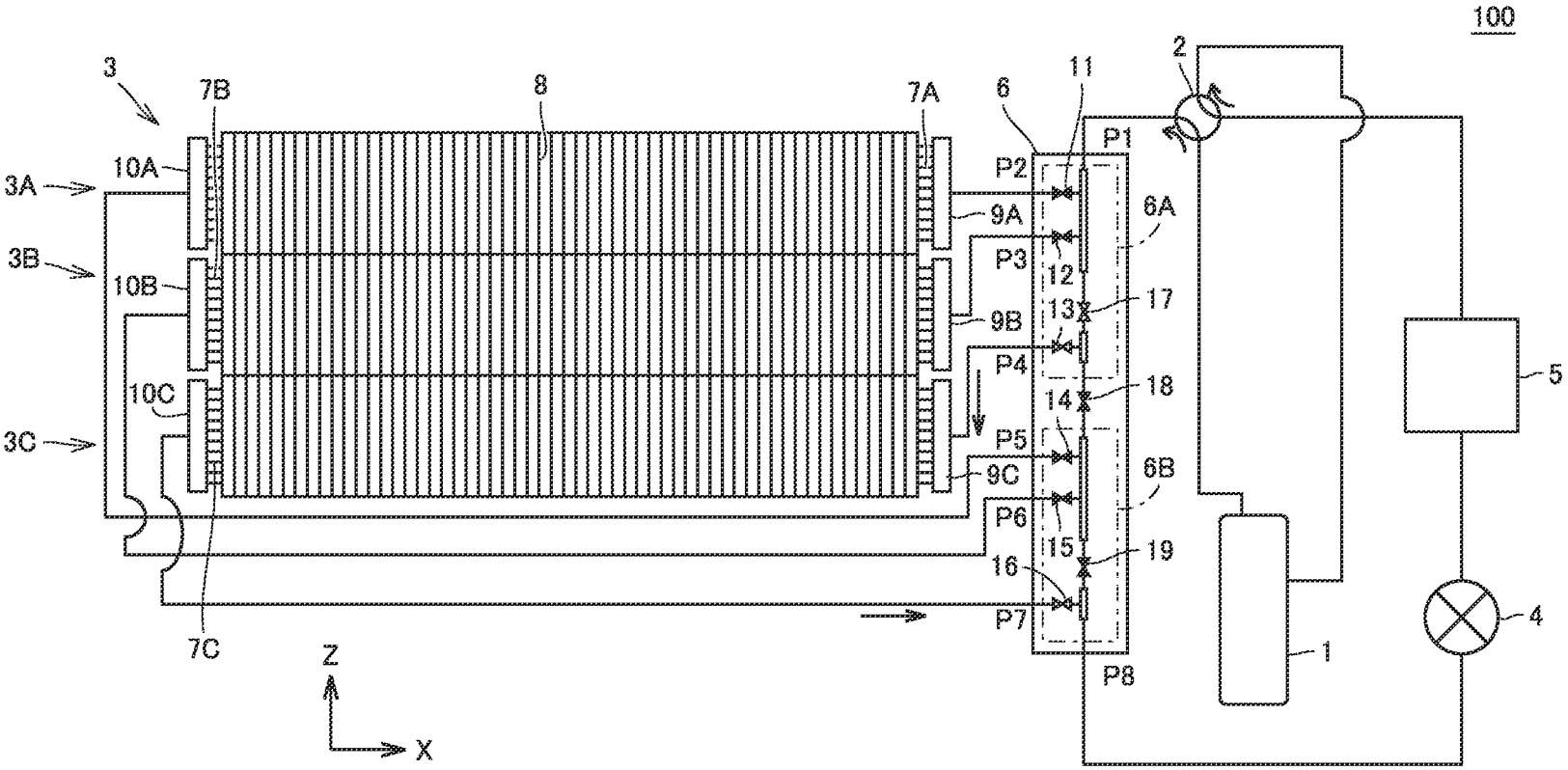
FIG. 5 is a view illustrating a refrigerant circuit when the refrigeration cycle apparatus according to the first embodiment is in a seventh state.

As illustrated in FIG. 5, in the seventh state, the third on-off valve 13, the sixth on-off valve 16 and the seventh on-off valve 17 are open, and the first on-off valve 11, the second on-off valve 12, the fourth on-off valve 14, the fifth on-off valve 15, the eighth on-off valve 18 and the ninth on-off valve 19 are closed.

<Operation of Refrigerating Cycle Apparatus>

Hereinafter, the operations performed by the refrigeration cycle apparatus 100 will be described.

<Cooling Operation>

When the refrigeration cycle apparatus 100 is made to perform the cooling operation, the third state, the fifth state, the sixth state, or the seventh state is selected in accordance with the cooling load. In the case where the cooling load is relatively great, the third state is selected. In the case where the refrigeration cycle apparatus 100 includes a plurality of indoor heat exchangers, the third state is selected, for example, during a cooling-only operation, and the fifth state, the sixth state or the seventh state is selected, for example, during a cooling-dominated operation.

As illustrated in FIG. 1, in the third state, the first heat exchange unit 3A and the third heat exchange unit 3C are connected in series by the second flow path switching unit 6, and the second heat exchange unit 3B and the third heat exchange unit 3C are connected in series in the first circuit section. The gas single-phase refrigerant discharged from the compressor 1 flows out from the first port P1 into the first conduit of the second flow path switching unit 6.

In the third state, the first on-off valve 11 and the second on-off valve 12 are open, and the seventh on-off valve 17 is closed. Therefore, a part of the gas single-phase refrigerant flown into the first conduit flows into the first distribution pipe 9A from the second port P2 through the second conduit, and exchanges heat with the outside air in the first heat exchange unit 3A, and thus is condensed therein. The liquid single-phase refrigerant or the gas-liquid two-phase refrigerant condensed in the first heat exchange unit 3A passes through the fourth distribution pipe 10A, and flows into the fifth conduit from the fifth port P5. The remainder of the gas single-phase refrigerant flown into the first conduit flows into the second distribution pipe 9B from the third port P3 through the third conduit, and exchanges heat with the outside air in the second heat exchange unit 3B, and thus is condensed therein. The liquid single-phase refrigerant or the gas-liquid two-phase refrigerant condensed in the second heat exchange unit 3B passes through the fifth distribution pipe 10B, and flows into the sixth pipe path from the sixth port P6.

Since the second on-off valve 12, the third on-off valve 13, the fifth on-off valve 15 and the sixth on-off valve 16 are open, and the seventh on-off valve 17 and the ninth on-off valve 19 are closed, all of the liquid single-phase refrigerant or the gas-liquid two-phase refrigerant flown into the sixth conduit flows into the third distribution pipe 9C from the fourth port P4, and exchanges heat with the outside air in the third heat exchange unit 3C, and thus is condensed therein. The liquid single-phase refrigerant condensed in the third heat exchange unit 3C passes through the sixth distribution pipe 10C, and flows into the seventh conduit from the seventh port P7. Since the sixth on-off valve 16 is open and the ninth on-off valve 19 is closed, all of the liquid single-phase refrigerant flown into the seventh conduit flows out from the eighth port P8 into the decompressor 4.

As illustrated in FIG. 3, in the fifth state, the refrigerant is not supplied to the second heat exchange unit 3B and the third heat exchange unit 3C, and thereby, none of the second heat exchange unit 3B and the third heat exchange unit 3C operates as a condenser. In the fifth state, only the first heat exchange unit 3A operates as a condenser. Specifically, the gas single-phase refrigerant discharged from the compressor 1 flows out from the first port P1 into the first conduit of the second flow path switching unit 6. Since the first on-off valve 11 is open and the second on-off valve 12 and the seventh on-off valve 17 are closed, all of the gas single-phase refrigerant flown into the first conduit flows into the first distribution pipe 9A from the second port P2, and exchanges heat with the outside air in the first heat exchange unit 3A, and thus is condensed therein. The liquid single-phase refrigerant or the gas-liquid two-phase refrigerant condensed in the first heat exchange unit 3A passes through the fourth distribution pipe 10A, and flows into the fifth conduit from the fifth port P5. Since the fourth on-off valve 14 and the ninth on-off valve 19 are open, and the fifth on-off valve 15, the sixth on-off valve 16 and the eighth on-off valve 18 are closed, all of the liquid single-phase refrigerant or the gas-liquid two-phase refrigerant flown into the fifth conduit flows out of the second flow path switching unit 6 from the eighth port P8.

As illustrated in FIG. 4, in the sixth state, the refrigerant is not supplied to the first heat exchange unit 3A and the third heat exchange unit 3C, and thereby, none of the first heat exchange unit 3A and the third heat exchange unit 3C operates as a condenser. In the seventh state, only the second heat exchange unit 3B operates as a condenser. Specifically, the gas single-phase refrigerant discharged from the compressor 1 flows out from the first port P1 into the first conduit of the second flow path switching unit 6. Since the second on-off valve 12 is open, and the first on-off valve 11 and the seventh on-off valve 17 are closed, all of the gas single-phase refrigerant flown into the first conduit flows into the second distribution pipe 9B through the third conduit, and exchanges heat with the outside air in the second heat exchange unit 3B, and thus is condensed therein. The liquid single-phase refrigerant or the gas-liquid two-phase refrigerant condensed in the second heat exchange unit 3B passes through the fifth distribution pipe 10B, and flows into the sixth conduit from the sixth port P6. Since the fifth on-off valve 15 and the ninth on-off valve 19 are open, and the fourth on-off valve 14, the sixth on-off valve 16 and the eighth on-off valve 18 are closed, all of the liquid single-phase refrigerant or the gas-liquid two-phase refrigerant flown into the sixth conduit flows out of the second flow path switching unit 6 from the eighth port P8.

As illustrated in FIG. 5, in the seventh state, the refrigerant is not supplied to the first heat exchange unit 3A and the second heat exchange unit 3B, and thereby, none of the first heat exchange unit 3A and the second heat exchange unit 3B operates as a condenser. In the fifth state, only the third heat exchange unit 3C operates as a condenser. Specifically, the gas single-phase refrigerant discharged from the compressor 1 flows out from the first port Pb into the first conduit of the second flow path switching unit 6. Since the third on-off valve 13 and the seventh on-off valve 17 are open, and the first on-off valve 11, the second on-off valve 12 and the eighth on-off valve 18 are closed, all of the gas single-phase refrigerant flown into the first conduit flows into the third distribution pipe 9C through the fourth pipe, and exchanges heat with the outside air in the third heat exchange unit 3C, and thus is condensed therein. The liquid single-phase refrigerant or the gas-liquid two-phase refrigerant condensed in the third heat exchange unit 3C passes through the sixth distribution pipe 10C, and flows into the seventh pipe path from the seventh port P7. Since the sixth on-off valve 16 is open and the eighth on-off valve 18 and the ninth on-off valve 19 are closed, all of the liquid single-phase refrigerant or the gas-liquid two-phase refrigerant flown into the seventh conduit flows out of the second flow path switching unit 6 from the eighth port P8.

<Heating Operation>

When the refrigeration cycle apparatus 100 is made to perform the heating operation, the fourth state is selected. As illustrated in FIG. 2, in the fourth state, the first heat exchange unit 3A, the third heat exchange unit 3C and the second heat exchange unit 3B are connected in parallel. Specifically, the gas single-phase refrigerant discharged from the compressor 1 is condensed in the indoor heat exchanger 5 illustrated in FIG. 1 into a liquid single-phase refrigerant. The liquid single-phase refrigerant is decompressed in the decompressor 4 into a gas-liquid two-phase refrigerant. The gas-liquid two-phase refrigerant flows into the first conduit of the second flow path switching unit 6 from the eighth port P8.

In the fourth state, the first on-off valve 11, the second on-off valve 12, the third on-off valve 13, the fourth on-off valve 14, the fifth on-off valve 15, the sixth on-off valve 16, the seventh on-off valve 17, and the ninth on-off valve 19 are open, and the eighth on-off valve 18 is closed. Therefore, a part of the gas-liquid two-phase refrigerant flown into the first conduit from the eighth port P8 flows out from the fifth port P5 into the fourth distribution pipe 10A, and exchanges heat with the outside air in the first heat exchange unit 3A, and thus is evaporated therein into a gas single-phase refrigerant. The other part of the gas-liquid two-phase refrigerant flown into the first conduit flows out from the sixth port P6 into the fifth distribution pipe 10B, and exchanges heat with the outside air in the second heat exchange unit 3B, and thus is evaporated therein into a gas single-phase refrigerant. The remainder of the gas-liquid two-phase refrigerant flown into the first conduit flows out from the seventh port P7 into the sixth distribution pipe 10C, and exchanges heat with the outside air in the third heat exchange unit 3C, and thus is evaporated therein into a gas single-phase refrigerant.

The gas single-phase refrigerant evaporated in the first heat exchange unit 3A passes through the first distribution pipe 9A, and flows into the second conduit through the second port P2. The gas single-phase refrigerant evaporated in the second heat exchange unit 3B passes through the second distribution pipe 9B, and flows into the third conduit through the third port P3. The gas single-phase refrigerant evaporated in the third heat exchange unit 3C passes through the third distribution pipe 9C, and flows into the fourth pipe path through the fourth port P4. Since the first on-off valve 11, the second on-off valve 12, the third on-off valve 13, the fourth on-off valve 14, the fifth on-off valve 15, the sixth on-off valve 16, the seventh on-off valve 17 and the ninth on-off valve 19 are open, and the eighth on-off valve 18 is closed, all of the gas single-phase refrigerant flows out of the second flow path switching unit 6 from the first port P1. The gas single-phase refrigerant flown out from the first port P1 is sucked into the suction port of the compressor 1.

<Effects>

The refrigeration cycle apparatus 100 includes a refrigerant circuit in which refrigerant circulates. The refrigerant circuit includes a compressor 1, a first flow path switching unit 2, an outdoor heat exchanger 3, a decompressor 4, an indoor heat exchanger 5, and a second flow path switching unit 6. The outdoor heat exchanger 3 includes a plurality of flat heat transfer tubes 7 which are spaced from each other in the first direction Z and configured to extend in the second direction X perpendicular to the first direction Z, a plurality of plate-shaped members which are spaced from each other in the second direction and connected to each of the plurality of flat heat transfer tubes 7, a first distributor 9 which is connected to one ends of the plurality of flat heat transfer tubes 7 in the second direction, and a second distributor 10 which is connected to the other end of the plurality of flat heat transfer tubes 7 in the second direction X. The number of one ends of the plurality of flat heat transfer tubes 7 in the second direction X is equal to the number of the other ends of the plurality of flat heat transfer tubes 7 in the second direction X. In the third direction Y perpendicular to the first direction Z and the second direction X, the plurality of flat heat transfer tubes 7 are arranged in one row.

The plurality of flat heat transfer tubes 7 includes a plurality of first flat heat transfer tubes 7A, a plurality of second flat heat transfer tubes 7B, and a plurality of third flat heat transfer tubes 7C which are arranged side by side in the first direction Z.

The first distributor 9 includes a first distribution pipe 9A which connects one ends of the plurality of first flat heat transfer tubes 7A in the second direction X in parallel, a second distribution pipe 9B which connects one ends of the plurality of second flat heat transfer tubes 7B in the second direction in parallel, and a third distribution pipe 9C which connects one ends of the plurality of third flat heat transfer tubes 7C in the second direction in parallel.

The second distributor 10 includes a fourth distribution pipe 10A which connects the other ends of the plurality of first flat heat transfer tubes 7A in the second direction in parallel, a fifth distribution pipe 10B which connects the other ends of the plurality of second flat heat transfer tubes 7B in the second direction in parallel, and a sixth distribution pipe 10C which connects the other ends of the plurality of third flat heat transfer tubes 7C in the second direction in parallel.

The first flow path switching unit 2 is configured to switch the refrigeration cycle apparatus between a first state in which the outdoor heat exchanger 3 operates as a condenser and the indoor heat exchanger 5 operates as an evaporator, and a second state in which the outdoor heat exchanger 3 operates as an evaporator and the indoor heat exchanger 5 operates as a condenser.

The second flow path switching unit 6 is provided with a first port P1, a second port P2, a third port P3, a fourth port P4, a fifth port P5, a sixth port P6, a seventh port P7, and an eighth port P8 through each of which the refrigerant flows in and out. The first port Pb is connected to the discharge port of the compressor 1 via the first flow path switching unit 2 in the first state, and is connected to the suction port of the compressor 1 via the first flow path switching unit 2 in the second state. The second port P2 is connected to the first distribution pipe 9A. The third port P3 is connected to the second distribution pipe 9B. The fourth port P4 is connected to the third distribution pipe 9C. The fifth port P5 is connected to the fourth distribution pipe 10A. The sixth port P6 is connected to the fifth distribution pipe 10B. The seventh port P7 is connected to the sixth distribution pipe 10C. The eighth port P8 is connected to the indoor heat exchanger 5 via the decompressor 4.

The second flow path switching unit 6 is configured to switch the refrigeration cycle apparatus between the third state and the fourth state. In the third state, the first port P1, the second port P2, the plurality of first flat heat transfer tubes 7A, the fifth port P5, the fourth port P4, the plurality of third flat heat transfer tubes 7C, the seventh port P7, and the eighth port P8 are connected in series in this order, and the first port P1, the third port P3, the plurality of second flat heat transfer tubes 7B, the sixth port P6, the fourth port P4, the plurality of third flat heat transfer tubes 7C, the seventh port P7, and the eighth port P8 are connected in series in this order. In the fourth state, the fifth port P5, the sixth port P6, and the seventh port P7 are connected in parallel to the eighth port P8, and the second port P2, the third port P3, and the fourth port P4 are connected in parallel to the first port P1.

According to the refrigeration cycle apparatus 100, the second flow path switching unit 6 is configured to switch the refrigeration cycle apparatus between the third state in which the first heat exchange unit 3A, the second heat exchange unit 3B, and the third heat exchange unit 3C are connected in series and the fourth state in which the first heat exchange unit 3A, the second heat exchange unit 3B, and the third heat exchange unit 3C are connected in parallel. By switching the refrigeration cycle apparatus to the third state during the cooling operation and to the fourth state during the heating operation by using the second flow path switching unit 6, it is possible to improve the heat exchange efficiency of the outdoor heat exchanger 3 of the refrigeration cycle apparatus 100 as compared with the heat exchange efficiency of the outdoor heat exchanger of a conventional refrigeration cycle apparatus which is not provided with at least one of the outdoor heat exchanger 3 and the second flow path switching unit 6 and thereby does not perform the switching mentioned above.

For example, as compared with a conventional refrigeration cycle apparatus which is maintained at the fourth state during the cooling and heating operation, the refrigeration cycle apparatus 100 is switched to the third state during the cooling operation, whereby the flow rate of the refrigerant flowing through each of the first flat heat transfer tube 7A, the second flat heat transfer tube 7B and the third flat heat transfer tube 7C during the cooling operation is increased as well as the flow velocity thereof, which improves the heat transfer efficiency of each tube. As a result, the condensation heat transfer performance of the refrigeration cycle apparatus 100 is higher than that of the refrigeration cycle apparatus, and thereby, the coefficient of performance COP of the refrigeration cycle apparatus 100 is improved higher than the coefficient of performance COP of the refrigeration cycle apparatus.

Further, for example, as compared with a conventional refrigeration cycle apparatus which is maintained at the third state during the cooling and heating operation, the refrigeration cycle apparatus 100 is switched to the fourth state during the heating operation, which makes it possible to reduce the pressure loss of the refrigerant flowing through each of the first flat heat transfer tube 7A, the second flat heat transfer tube 7B, and the third flat heat transfer tube 7C during the heating operation. As a result, the coefficient of performance COP of the refrigeration cycle apparatus 100 is improved higher than the coefficient of performance COP of the refrigeration cycle apparatus.

Further, in the refrigeration cycle apparatus 100, the second flow path switching unit 6 is formed as an integral unit. Therefore, the switching of the third state, the fourth state, the fifth state, the sixth state and the seventh state is realized by switching the conduits inside the second flow path switching unit 6. The refrigerant pipes arranged in the outdoor apparatus outside the second flow path switching unit 6 are limited to those pipes connected to each port of the second flow path switching unit 6 and to each of the four-way valve 2, the outdoor heat exchanger 3, and the decompressor 4. Therefore, it is possible to simply the arrangement of the pipes inside the outdoor apparatus in the refrigeration cycle apparatus 100 as compared with the arrangement of the pipes in a conventional refrigeration cycle apparatus without being switched by using the second flow path switching unit 6.

Further, according to the refrigeration cycle apparatus 100, in the third state, a part of the gas single-phase refrigerant discharged from the compressor 1 is condensed in the first heat exchange unit 3A into a gas-liquid two-phase refrigerant having a lower degree of dryness, and the remainder of the gas single-phase refrigerant is condensed in the second heat exchange unit 3B into a gas-liquid two-phase refrigerant having a lower degree of dryness. Thereafter, the gas-liquid two-phase refrigerant in two parts merges in the second flow path switching unit 6, and is further condensed in the third heat exchange unit 3C into a liquid single-phase refrigerant.

Therefore, as compared with a conventional refrigeration cycle apparatus which is filled with the same amount of refrigerant as that in the refrigeration cycle apparatus 100 but includes the same number of heat exchange units connected in series, when the refrigeration cycle apparatus 100 is in the third state, the flow rate of refrigerant flowing through each of the first heat exchange unit 3A and the second heat exchange unit 3B becomes smaller than the flow rate of refrigerant flowing through the comparative example. Therefore, the flow velocity of the gas single-phase refrigerant or the gas-liquid two-phase refrigerant flowing through each of the first heat exchange unit 3A and the second heat exchange unit 3B of the refrigeration cycle apparatus 100 becomes slower than the flow velocity of the gas single-phase refrigerant or the gas-liquid two-phase refrigerant flowing through the comparative example. As a result, when the refrigeration cycle apparatus 100 is in the third state, the pressure loss of the gas single-phase refrigerant or the gas-liquid two-phase refrigerant flowing through each of the first heat exchange unit 3A and the second heat exchange unit 3B is smaller than the pressure loss of the gas single-phase refrigerant or the gas-liquid two-phase refrigerant flowing through the comparative example.

In other words, even though the flow velocity of the liquid single-phase refrigerant flowing through the third heat exchange unit 3C of the refrigeration cycle apparatus 100 in the third state is made equal to the flow velocity of the liquid single-phase refrigerant flowing through the comparative example, the flow velocity of the gas-liquid two-phase refrigerant flowing through the first heat exchange unit 3A and the second heat exchange unit 3B in the third state is smaller than the flow velocity of the gas-liquid two-phase refrigerant flowing through the comparative example. Therefore, the condensation heat transfer performance of the refrigeration cycle apparatus 100 during the cooling operation is improved higher than the condensation heat transfer performance of the comparative example during the cooling operation.

Further, even when the specifications of the first heat exchange unit 3A, the second heat exchange unit 3B, and the third heat exchange unit 3C connected thereto are changed, there is no need to change the relative positional arrangement between the first port P1, the second port P2, the third port P3, the fourth port P4, the fifth port P5, the sixth port P6, the seventh port P7 and the eighth port P8 in the second flow path switching unit 6. Therefore, the same second flow path switching unit 6 may be used in a plurality of refrigeration cycle apparatuses 100 having different horse power or the like. In other words, there is no need to change the design or the layout of the refrigerant pipes in accordance with the horse power, the spread period and the performance level of the refrigeration cycle apparatus 100. In other words, in the refrigeration cycle apparatus 100, the design of the refrigerant pipes accommodated in the outdoor apparatus may be standardized.

Further, as compared with a conventional refrigeration cycle apparatus which is necessary to modify the layout of refrigerant pipes including check valves and electromagnetic valves in accordance with the horse power or the like thereof, the layout of refrigerant pipes in the outdoor apparatus of the refrigeration cycle apparatus 100 may be simplified and the length of each refrigerant pipe may be shortened. As a result, it is possible to reduce the installation space of the refrigerant pipes in the outdoor apparatus as compared with a conventional refrigeration cycle apparatus, which makes it possible to reduce the manufacturing cost of the refrigeration cycle apparatus 100 lower than that of the refrigeration cycle apparatus.

In addition to the third state and the fourth state, the refrigeration cycle apparatus 100 may be switched by the second flow path switching unit 6 between the fifth state in which refrigerant is supplied only to the first heat exchange unit 3A, the sixth state in which refrigerant is supplied only to the second heat exchange unit 3B, and the seventh state in which refrigerant is supplied only to the third heat exchange unit 3C. The fifth state, the sixth state or the seventh state is selected during the cooling operation in which the cooling load is relatively small (i.e., low cooling load operation).

If the heat radiation capacity of a condenser becomes excessively large, the condensation pressure decreases as compared with that during the normal cooling operation. As a result, the saturation temperature of the gas-phase refrigerant to be supplied to the indoor heat exchanger during the heating operation decreases, and thereby, the required heating capability cannot be obtained. If the compression ratio (condensation pressure/evaporation pressure) is maintained low due to the decrease in the condensation pressure, the reliability of the compressor is reduced.

The refrigeration cycle apparatus 100 may be switched to the fifth state, the sixth state or the seventh state by using the second flow path switching unit 6, whereby the heat radiation capacity of the condenser may be lowered. Therefore, for example, when the cooling-dominated operation is performed when the temperature of the outside air is low, the heat radiation capacity of the condenser may be prevented from becoming excessively large, which makes it possible to prevent the condensation pressure from being reduced in the normal cooling operation. As a result, even when the refrigeration cycle apparatus 100 is performing the cooling-dominated operation when the temperature of the outside air is low, it is possible to obtain the required heating capacity. In this case, since the reduction of the condensation pressure in the refrigeration cycle apparatus 100 is suppressed, it is possible to ensure the reliability of the compressor 1.

Further, if the first heat exchange unit 3A, the second heat exchange unit 3B, and the third heat exchange unit 3C of the refrigeration cycle apparatus 100 are provided to have different capacities, it is possible to finely control the condensation heat transfer performance of the refrigeration cycle apparatus 100 during the cooling operation by switching it between the fifth state, the sixth state and the seventh state in response to the cooling load.

Second Embodiment

The refrigeration cycle apparatus according to a second embodiment has basically the same configuration as the refrigeration cycle apparatus 100 according to the first embodiment, except that the long axis of the flat shape of each of the plurality of first flat heat transfer tubes 7A, the plurality of second flat heat transfer tubes 7B, and the plurality of third flat heat transfer tubes 7C of the outdoor heat exchanger 3 is inclined with respect to the horizontal direction. In the second embodiment, the first direction Z is the direction of gravity.

Figure 6:
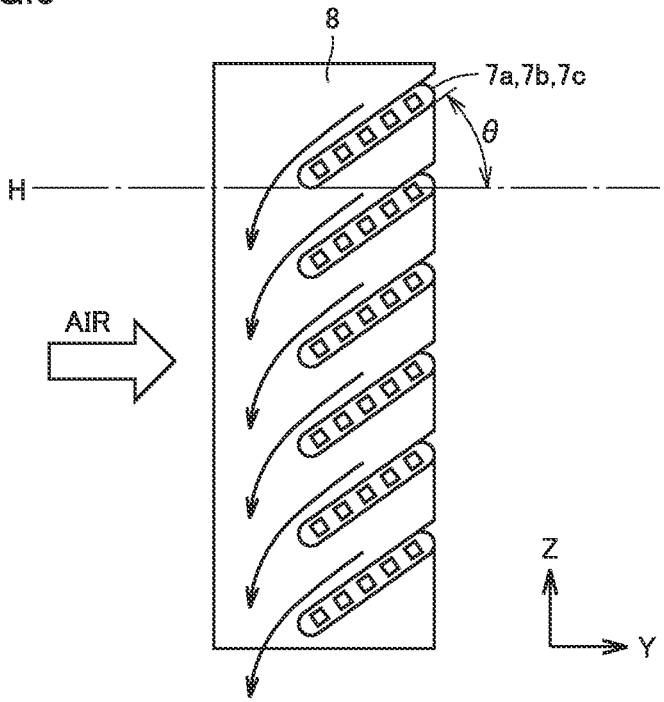
FIG. 6 is a view illustrating a plurality of flat heat transfer tubes and fins in a refrigeration cycle apparatus according to a second embodiment.

As illustrated in FIG. 6, the long axis of the flat shape of each of the plurality of first flat heat transfer tubes 7A, the plurality of second flat heat transfer tubes 7B, and the plurality of third flat heat transfer tubes 7C is inclined at an angle θ with respect to a horizontal line H that extends in the horizontal direction. The inclination angle formed by the long axis of each of the plurality of first flat heat transfer tubes 7A and the horizontal line H, the inclination angle formed by the long axis of each of the plurality of second flat heat transfer tubes 7B and the horizontal line H, and the inclination angle formed by the long axis of each of the plurality of third flat heat transfer tubes 7C and the horizontal line H are equal to each other, for example.

As illustrated in FIG. 6, when each insertion hole, through which each first flat heat transfer tube 7A, each second flat heat transfer tube 7B or each third flat heat transfer tube 7C is inserted, is formed on the plate-shaped member 8 as a notch, the opening of the notch is arranged leeward when the outdoor fan blows air to the outdoor heat exchanger 3 in the third direction Y.

Since the refrigeration cycle apparatus according to the second embodiment has basically the same configuration as that of the refrigeration cycle apparatus 100 according to the first embodiment, the same effect as that of the refrigeration cycle apparatus 100 may be achieved.

Further, when the refrigeration cycle apparatus is performing the heating operation, moisture contained in the outside air is condensed in the outdoor heat exchanger 3, which generates condensed water on the surface of each flat heat transfer tube. When a part of the condensed water adheres to the surface of each flat heat transfer tube as a frost, the frost inhibits heat exchange with the outdoor air, thereby reducing the heating efficiency of the refrigeration cycle apparatus. As the length of the long axis of each flat heat transfer tube becomes longer, the condensed water is more likely to stay on the surface of each flat heat transfer tube, and thereby adheres to the surface as a frost.

In contrast, in the refrigeration cycle apparatus according to the second embodiment, even when the length of the long axis of the flat shape of each of the plurality of first flat heat transfer tubes 7A, the plurality of second flat heat transfer tubes 7B, and the plurality of third flat heat transfer tubes 7C is made longer, the drainage of water is enhanced in the outdoor heat exchanger 3. Therefore, the refrigeration cycle apparatus according to the second embodiment may be suitably used as a high horsepower refrigeration cycle apparatus.

Figure 7:
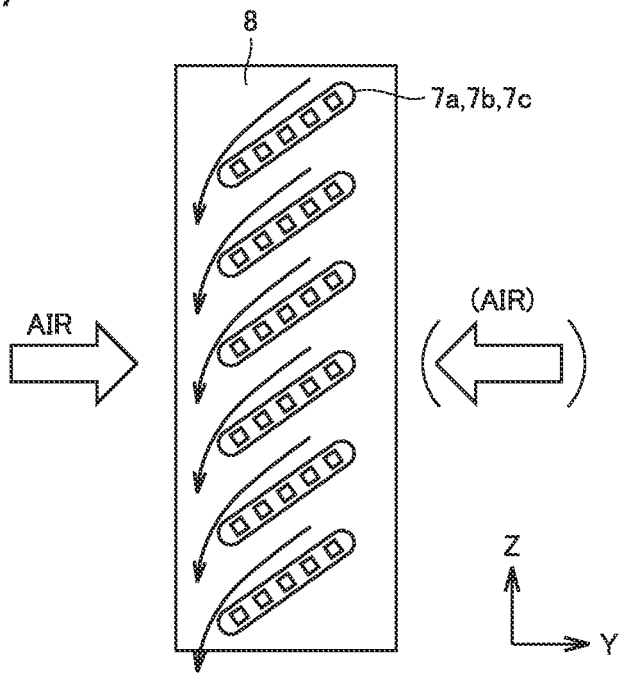
FIG. 7 is a view illustrating a modified example of a plurality of flat heat transfer tubes and fins in the refrigeration cycle apparatus according to the second embodiment.

As illustrated in FIG. 7, in the refrigeration cycle apparatus according to the second embodiment, each insertion hole of the plate-shaped member 8 may also be formed as a through hole. In this case, the direction of blowing air to the outdoor heat exchanger 3 is not particularly limited.

Figure 8:
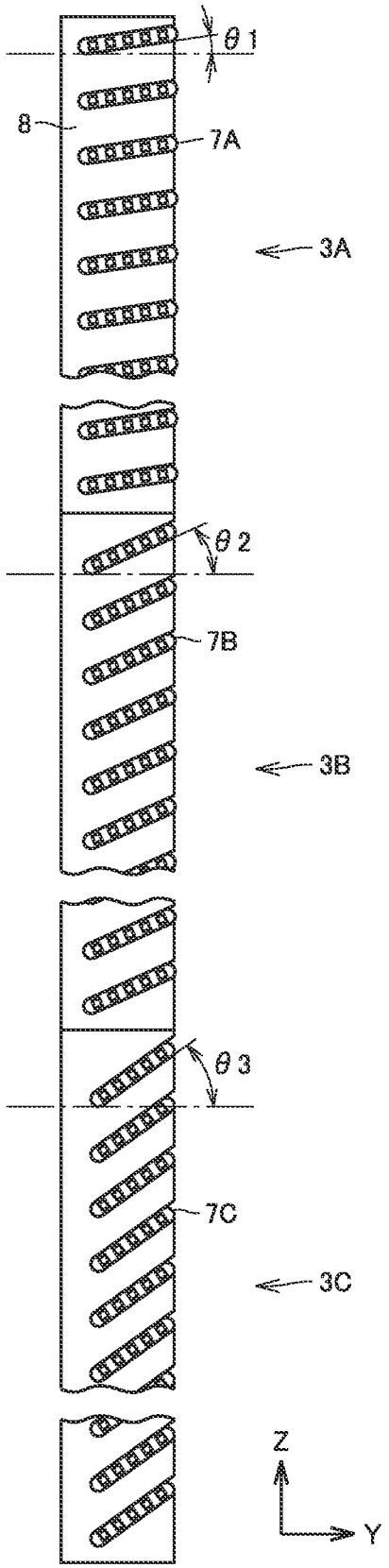
FIG. 8 is a view illustrating another modified example of a plurality of flat heat transfer tubes and fins in the refrigeration cycle apparatus according to the second embodiment.

As illustrated in FIG. 8, it is preferable that the inclination angle θ1 formed by the long axis of the flat shape of each of the plurality of first flat heat transfer tubes 7A of the outdoor heat exchanger 3 with respect to the horizontal direction, the inclination angle θ2 formed by the long axis of the flat shape of each of the plurality of second flat heat transfer tubes 7B with respect to the horizontal direction, and the inclination angle θ3 formed by the long axis of the flat shape of each of the plurality of third flat heat transfer tubes 7C with respect to the horizontal direction satisfy the relationship of $\theta 1<\theta 2<\theta 3$.

During the heating operation or the defrosting operation of the refrigeration cycle apparatus described above, among the plurality of flat heat transfer tubes, a group of flat heat transfer tubes that are disposed relatively lower in the direction of gravity are disposed on the drainage path of another group of flat heat transfer tubes that are disposed higher than the group of flat heat transfer tubes. Therefore, a larger amount of water flows around the group of flat heat transfer tubes that are disposed relatively lower in the direction of gravity than another group of flat heat transfer tubes that are disposed higher than the group of flat heat transfer tubes. In addition, due to the effect of gravity, water tends to stay around the group of flat heat transfer tubes that are disposed relatively lower in the direction of gravity as compared with another group of flat heat transfer tubes that are disposed higher than the group of flat heat transfer tubes. Specifically, the plurality of third flat heat transfer tubes 7C are required to have higher drainage capacity than the plurality of second flat heat transfer tubes 7B, and the plurality of second flat heat transfer tubes 7B are required to have higher drainage capacity than the plurality of first flat heat transfer tubes 7A. Therefore, when the outdoor heat exchanger 3 operates as an evaporator, the heat exchange efficiency of the refrigeration cycle apparatus which satisfies the relationship of $\theta 1<\theta 2<\theta 3$ is improved as compared with the refrigeration cycle apparatus which does not satisfy the relationship. Also in this case, each insertion hole may be formed in the plate-shaped member 8 as a notch as illustrated in FIG. 8, for example, or may be formed as a through hole as mentioned above.

Third Embodiment

The refrigeration cycle apparatus according to a third embodiment has basically the same configuration as that of the refrigeration cycle apparatus 100 according to the first embodiment, except that when the outdoor heat exchanger 3 is viewed from the first direction Z, each of the plurality of first flat heat transfer tubes 7A, the plurality of second flat heat transfer tubes 7B, and the plurality of third flat heat transfer tubes 7C has at least one bent portion.

Figure 9:
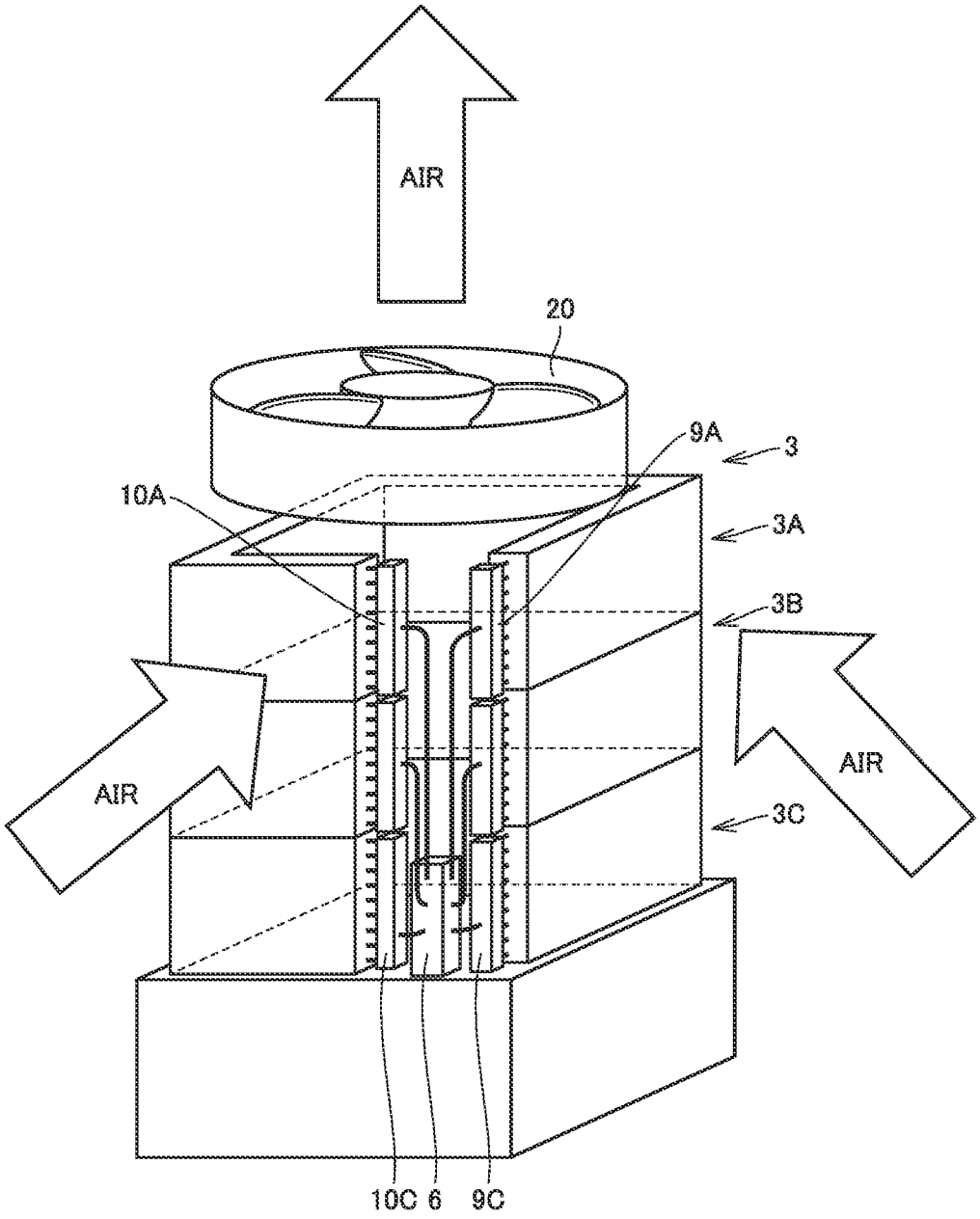
FIG. 9 is a view illustrating an outdoor heat exchanger of a refrigeration cycle apparatus according to a third embodiment.

As illustrated in FIG. 9, the outdoor heat exchanger 3 is, for example, a so-called top-flow heat exchanger. The outdoor fan 20 is disposed above the outdoor heat exchanger 3, and the rotation shaft of the outdoor fan 20 is arranged in the first direction Z.

Each of the plurality of first flat heat transfer tubes 7A, the plurality of second flat heat transfer tubes 7B and the plurality of third flat heat transfer tubes 7C has, for example, three bent portions. Each of the plurality of first flat heat transfer tubes 7A, the plurality of second flat heat transfer tubes 7B and the plurality of third flat heat transfer tubes 7C is bent at three locations so that the long axis of the flat shape of each flat heat transfer tube in each extending direction faces toward a different direction. When the outdoor heat exchanger 3 is viewed from the first direction Z, each of the plurality of first flat heat transfer tubes 7A, the plurality of second flat heat transfer tubes 7B and the plurality of third flat heat transfer tubes 7C is arranged to surround an axis extending in the first direction Z. The bent portion is formed by joining each linearly extending flat heat transfer tube to the plate-shaped members 8 and then bending each flat heat transfer tube.

The shortest distance between both ends each of the plurality of first flat heat transfer tubes 7A, the plurality of second flat heat transfer tubes 7B, and the plurality of third flat heat transfer tubes 7C in each extending direction is shorter than the creeping distance between both ends of each of the plurality of first flat heat transfer tubes 7A, the plurality of second flat heat transfer tubes 7B, and the plurality of third flat heat transfer tubes 7C in each extending direction.

Preferably, as illustrated in FIGS. 6 to 8, the long axis of the flat shape of each of the plurality of first flat heat transfer tubes 7A, the plurality of second flat heat transfer tubes 7B, and the plurality of third flat heat transfer tubes 7C is inclined at an angle θ with respect to the horizontal line H that extends in the horizontal direction. In this case, when the outdoor heat exchanger 3 is viewed from the first direction Z, the inner peripheral end of each flat heat transfer tube 7 is arranged above the outer peripheral end thereof.

In the cross section perpendicular to the second direction X, the ratio (aspect ratio) of the length of the long axis of each of the plurality of first flat heat transfer tubes 7A, the plurality of second flat heat transfer tubes 7B, and the plurality of third flat heat transfer tubes 7C to the length of the short axis thereof is 15 or more from the viewpoint of improving the heat exchange efficiency of the outdoor heat exchanger 3. Further, the aspect ratio is 23 or less from the viewpoint of increasing the yield rate of the outdoor heat exchanger 3.

Figure 10:
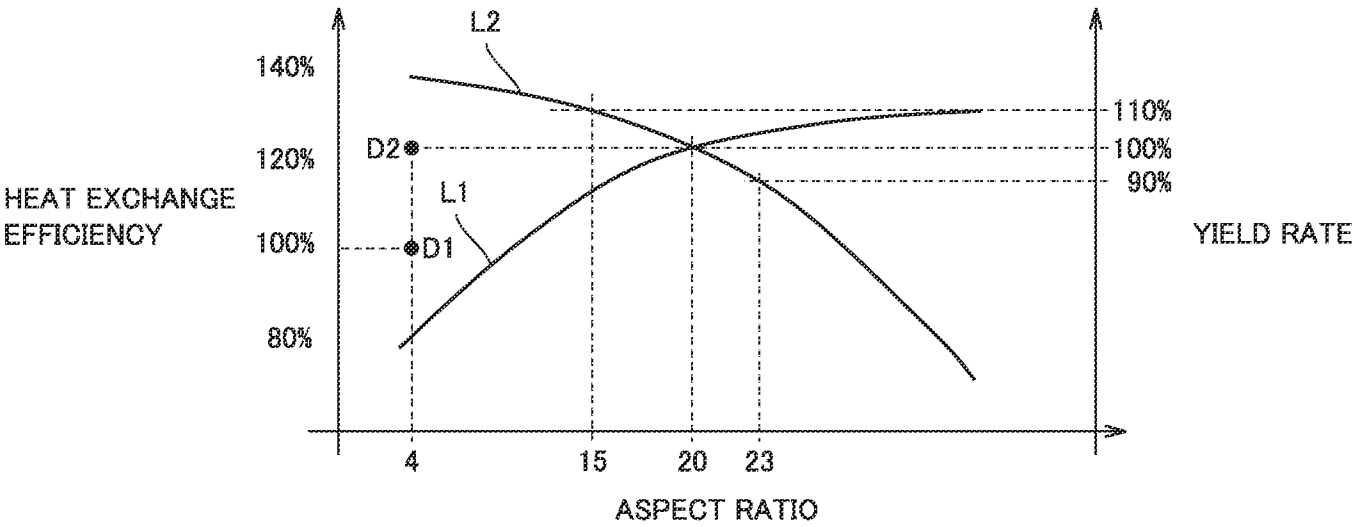
FIG. 10 is a graph illustrating the relationship between a ratio of the length of the long axis to the length of the short axis of a flat heat transfer tube and the heat exchange efficiency of an outdoor heat exchanger and the relationship between the ratio and a yield rate of the outdoor heat exchanger of the refrigeration cycle apparatus according to the third embodiment.

FIG. 10 is a graph illustrating the relationship between the theoretically calculated aspect ratio and the heat exchange efficiency of the outdoor heat exchanger 3, and the relationship between the empirically calculated aspect ratio and the yield rate of the outdoor heat exchanger 3. The horizontal axis in FIG. 10 represents the aspect ratio. The left vertical axis in FIG. 10 represents the ratio of the heat exchange efficiency of the outdoor heat exchanger 3 illustrated in FIG. 9 when the heat exchange efficiency of a multiple-row heat exchanger (hereinafter referred to as the multiple-row heat exchanger of the comparative example) in which the heat exchange units are arranged in two rows in the air-flowing direction, the aspect ratio of each flat heat transfer tube is 4, and each flat heat transfer tube has three bent portions is set to 100%. The right vertical axis in FIG. 10 represents the yield rate of the outdoor heat exchanger 3 illustrated in FIG. 9 when the yield rate of the multiple-row heat exchanger of the comparative example is set to 100%. It is assumed that the multiple-row heat exchanger of the comparative example is only different from the outdoor heat exchanger illustrated in FIG. 9 in that the heat exchanger is a multiple-row heat exchanger and the aspect ratio is 4. A plot D1 in FIG. 10 shows the relationship between the aspect ratio and the heat exchange efficiency of the multiple-row heat exchanger of the comparative example, and a plot D2 shows the relationship between the aspect ratio and the yield rate of the multiple-row heat exchanger of the comparative example.

As illustrated in FIG. 10, as the aspect ratio increases, the heat transfer area of the outdoor heat exchanger 3 increases, which improves the heat exchange efficiency of the outdoor heat exchanger 3. On the other hand, as the aspect ratio increases, it is more likely that the flat heat transfer tube collapses or the plate-shaped member falls down when the flat heat transfer tube is bent after the flat heat transfer tube and the plate-shaped member are joined to each other, which lowers the yield rate of the outdoor heat exchanger 3. The outdoor heat exchanger 3 having an aspect ratio of 15 or more and 20 or less exhibits a yield rate equal to or more than that of the multiple-row heat exchanger of the comparative example while having a higher heat exchange efficiency. In addition, the outdoor heat exchanger 3 having an aspect ratio of more than 20 and less than or equal to 23 has an extremely higher heat exchange efficiency than the multiple-row heat exchanger of the comparative example, and the reduction of the yield rate is suppressed to 10% or less.

In other words, since the outdoor heat exchanger 3 according to the third embodiment has an aspect ratio of 15 or more, it has a higher heat exchange efficiency, and since the outdoor heat exchanger 3 according to the third embodiment has an aspect ratio of 23 or less, it has a lower reduction in the yield rate even if it is provided with three bending portions in the bending process.

Further, the shortest distance between both ends of each of the plurality of flat heat transfer tubes 7 in the extending direction is shorter than the creeping distance thereof. Therefore, it is possible to minimize the structural dead space in the outdoor heat exchanger 3.

Further, the outdoor heat exchanger 3 is configured as a top-flow heat exchanger and the inner peripheral end of each flat heat transfer tube 7 is disposed above the outer peripheral end thereof, the flow separation is less likely to occur around each flat heat transfer tube 7, which reduces the ventilation resistance. As a result, it is possible to improve the aerodynamic characteristic of the outdoor fan and reduce the input power and noise of the fan motor.

Since the refrigeration cycle apparatus according to the third embodiment has basically the same configuration as that of the refrigeration cycle apparatus 100 according to the first embodiment, the same effect as that of the refrigeration cycle apparatus 100 may be achieved.

The outdoor heat exchanger 3 of the refrigeration cycle apparatus according to the first to third embodiments may include, for example, four or more heat exchange units. In this case, the number of ports and electromagnetic valves to be provided in the second flow path switching unit 6 is increased in accordance with the number of heat exchange units. The third state in which four or more heat exchange units are connected in series with each other may be switched by the second flow path switching unit 6.

It should be understood that the embodiment disclosed herein is merely by way of illustration and example but not limited in all aspects. The scope of the present invention is defined by the terms of the claims, rather than the description above, and is intended to include any modifications within the meaning and scope equivalent to the terms of the claims.

The invention claimed is:

1. A refrigeration cycle apparatus comprising:

a refrigerant circuit in which refrigerant circulates, wherein the refrigerant circuit includes:

a compressor;

a first flow path switching unit;

a second flow path switching unit;

a decompressor;

an indoor heat exchanger; and an outdoor heat exchanger, the outdoor heat exchanger includes:

a plurality of flat heat transfer tubes which are spaced from each other in a first direction and configured to extend in a second direction perpendicular to the first direction;

a plurality of plate-shaped members which are spaced from each other in the second direction and connected to each of the plurality of flat heat transfer tubes;

a first distributor which is connected to one ends of the plurality of flat heat transfer tubes in the second direction, and a second distributor which is connected to the other ends of the plurality of flat heat transfer tubes in the second direction, the number of one ends of the plurality of flat heat transfer tubes in the second direction is equal to the number of the other ends of the plurality of flat heat transfer tubes in the second direction, the plurality of flat heat transfer tubes are arranged in one row in a third direction perpendicular to the first direction and the second direction, the plurality of flat heat transfer tubes includes a plurality of first flat heat transfer tubes, a plurality of second flat heat transfer tubes, and a plurality of third flat heat transfer tubes which are arranged side by side in the first direction, the first distributor includes:

a first distribution pipe which connects one ends of the plurality of first flat heat transfer tubes in the second direction in parallel;

a second distribution pipe which connects one ends of the plurality of second flat heat transfer tubes in the second direction in parallel; and a third distribution pipe which connects one ends of the plurality of third flat heat transfer tubes in the second direction in parallel, the second distributor includes:

a forth distribution pipe which connects the other ends of the plurality of first flat heat transfer tubes in the second direction in parallel;

a fifth distribution pipe which connects the other ends of the plurality of second flat heat transfer tubes in the second direction in parallel; and a sixth distribution pipe which connects the other ends of the plurality of third flat heat transfer tubes in the second direction in parallel, the first flow path switching unit is configured to switch the refrigeration cycle apparatus between a first state and a second state, in the first state, the outdoor heat exchanger operates as a condenser and the indoor heat exchanger operates as an evaporator, and in the second state, the outdoor heat exchanger operates as an evaporator and the indoor heat exchanger operates as a condenser, the second flow path switching unit is provided with a first port, a second port, a third port, a fourth port, a fifth port, a sixth port, a seventh port, and an eighth port through each of which the refrigerant flows in and out, the first port is connected to a discharge port of the compressor via the first flow path switching unit in the first state, and connected to a suction port of the compressor via the first flow path switching unit in the second state, the second port is connected to the first distribution pipe, the third port is connected to the second distribution pipe, the fourth port is connected to the third distribution pipe, the fifth port is connected to the fourth distribution pipe, the sixth port is connected to the fifth distribution pipe, the seventh port is connected to the sixth distribution pipe, and the eighth port is connected to the indoor heat exchanger via the decompressor, the second flow switching unit is configured to switch the refrigeration cycle apparatus between a third state, a fourth state, a fifth state, a sixth state, and a seventh state, in the third state, the first port, the second port, the plurality of first flat heat transfer tubes, the fifth port, the fourth port, the plurality of third flat heat transfer tubes, the seventh port, and the eighth port are connected in series in this order, and the first port, the third port, the plurality of second flat heat transfer tubes, the sixth port, the fourth port, the plurality of third flat heat transfer tubes, the seventh port, and the eighth port are connected in series in this order, in the fourth state, the fifth port, the sixth port, and the seventh port are connected in parallel to the eighth port, and the second port, the third port, and the fourth port are connected in parallel to the first port in the fifth state, the first port, the second port, the plurality of first flat heat transfer tubes, the fifth port, and the eighth port are connected in series in this order, in the sixth state, the first port, the third port, the plurality of second flat heat transfer tubes, the sixth port, and the eighth port are connected in series in this order, and in the seventh state, the first port, the fourth port, the plurality of third flat heat transfer tubes, the seventh port, and the eighth port are connected in series in this order.

2. The refrigeration cycle apparatus according to claim 1, wherein when the outdoor heat exchanger is viewed from the first direction, each of the plurality of first flat heat transfer tubes, the plurality of second flat heat transfer tubes and the plurality of third flat heat transfer tubes has at least one bent portion, and in a cross section perpendicular to the second direction, a ratio of a length of a long axis to a length of a short axis for each of the plurality of first flat heat transfer tubes, each of the plurality of second flat heat transfer tubes, and each of the plurality of third flat heat transfer tubes is 15 or more and 23 or less.

3. The refrigeration cycle apparatus according to claim 2, wherein the at least one bent portion includes three bent portions, and when the outdoor heat exchanger is viewed from the first direction, each of the plurality of first flat heat transfer tubes, the plurality of second flat heat transfer tubes and the plurality of third flat heat transfer tubes is arranged so as to surround an axis that extends in the first direction.

4. The refrigeration cycle apparatus according to claim 1, wherein the first direction is the direction of gravity, the plurality of first flat heat transfer tubes are arranged on one side of the first direction, the plurality of third flat heat transfer tubes are arranged on the other side of the first direction, in a cross section perpendicular to the second direction, a long axis of each of the plurality of first flat heat transfer tubes, the plurality of second flat heat transfer tubes and the plurality of third flat heat transfer tubes is inclined with respect to a horizontal direction, an angle formed by the long axis of each of the plurality of second flat heat transfer tubes with respect to the horizontal direction is larger than an angle formed by the long axis of each of the plurality of first flat heat transfer tubes with respect to the horizontal direction, and an angle formed by the long axis of each of the plurality of third flat heat transfer tubes with respect to the horizontal direction is larger than the angle formed by the long axis of each of the plurality of second flat heat transfer tubes with respect to the horizontal direction.

5. The refrigeration cycle apparatus according to claim 2, wherein the first direction is the direction of gravity, the plurality of first flat heat transfer tubes are arranged on one side of the first direction, the plurality of third flat heat transfer tubes are arranged on the other side of the first direction, in a cross section perpendicular to the second direction, a long axis of each of the plurality of first flat heat transfer tubes, the plurality of second flat heat transfer tubes and the plurality of third flat heat transfer tubes is inclined with respect to a horizontal direction, an angle formed by the long axis of each of the plurality of second flat heat transfer tubes with respect to the horizontal direction is larger than an angle formed by the long axis of each of the plurality of first flat heat transfer tubes with respect to the horizontal direction, and an angle formed by the long axis of each of the plurality of third flat heat transfer tubes with respect to the horizontal direction is larger than the angle formed by the long axis of each of the plurality of second flat heat transfer tubes with respect to the horizontal direction.

6. The refrigeration cycle apparatus according to claim 3, wherein the first direction is the direction of gravity, the plurality of first flat heat transfer tubes are arranged on one side of the first direction, the plurality of third flat heat transfer tubes are arranged on the other side of the first direction, in a cross section perpendicular to the second direction, a long axis of each of the plurality of first flat heat transfer tubes, the plurality of second flat heat transfer tubes and the plurality of third flat heat transfer tubes is inclined with respect to a horizontal direction, an angle formed by the long axis of each of the plurality of second flat heat transfer tubes with respect to the horizontal direction is larger than an angle formed by the long axis of each of the plurality of first flat heat transfer tubes with respect to the horizontal direction, and an angle formed by the long axis of each of the plurality of third flat heat transfer tubes with respect to the horizontal direction is larger than the angle formed by the long axis of each of the plurality of second flat heat transfer tubes with respect to the horizontal direction.

* * * * *